US006314989B1

(12) United States Patent
Fritz et al.

(10) Patent No.: US 6,314,989 B1
(45) Date of Patent: Nov. 13, 2001

(54) DEVICE FOR DRAINING OF OIL IN A COMPONENT OF A VEHICLE

(75) Inventors: Walter Fritz, Immenstaad; Reinhold Mayer, Eriskirch, both of (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/421,859

(22) Filed: Oct. 20, 1999

(30) Foreign Application Priority Data

Nov. 2, 1998 (DE) ..... 198 50 382

(51) Int. Cl.[7] ..... F16K 31/18

(52) U.S. Cl. ..... 137/449; 137/351; 184/1.5

(58) Field of Search ..... 137/351, 434, 137/449, 614.11; 184/1.5; 222/501, 507, 509, 511, 518; 251/89.5, 339, 354, 291

(56) References Cited

U.S. PATENT DOCUMENTS

| | | | | |
|---|---|---|---|---|
| 2,105,649 | | 1/1938 | Hennessy | 251/337 |
| 2,450,461 | * | 10/1948 | Wallach | 137/614.11 |
| 2,704,156 | | 3/1955 | Botstiber | 210/222 |
| 2,941,622 | * | 6/1960 | Mosley | 137/449 |
| 3,871,483 | * | 3/1975 | Espinosa et al. | 184/1.5 |
| 4,150,809 | * | 4/1979 | Muller | 251/149.4 |
| 4,524,800 | * | 6/1985 | Holland | 137/516.27 |
| 4,917,356 | * | 4/1990 | Shirdavani | 251/294 |

FOREIGN PATENT DOCUMENTS 43 17 482 A1 2/1995 (DE) .

* cited by examiner

*Primary Examiner*—George L. Walton
(74) *Attorney, Agent, or Firm*—Davis & Bujold, P.L.L.C.

(57) ABSTRACT

The device for complete draining of the oil in a component of a motor vehicle such as hydraulic steering, transmission with converter or automatic transmission which has within the component, an oil drain valve for at least one oil chamber in the component, which oil drain valve is automatically opened when the plug of the component is removed.

10 Claims, 6 Drawing Sheets

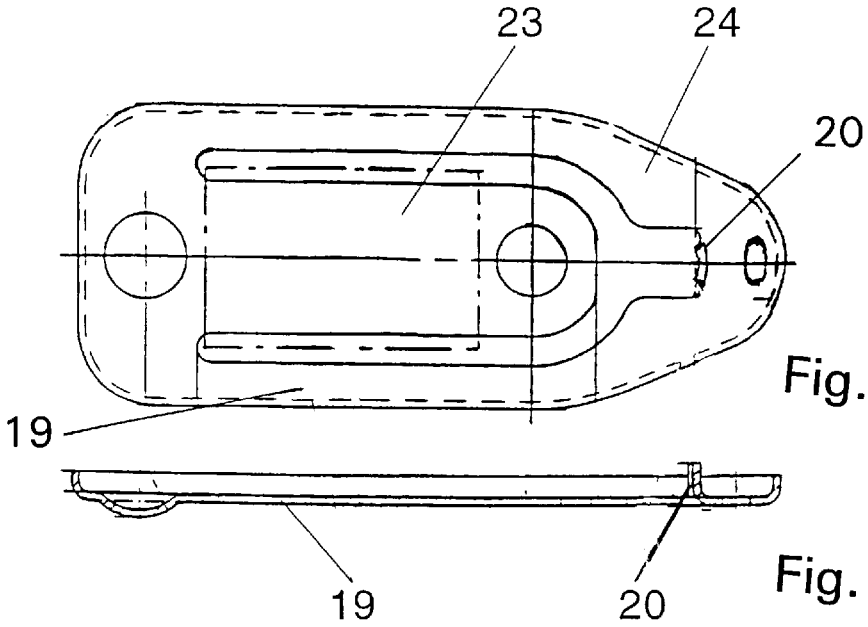
Fig. 10a
Fig. 10b
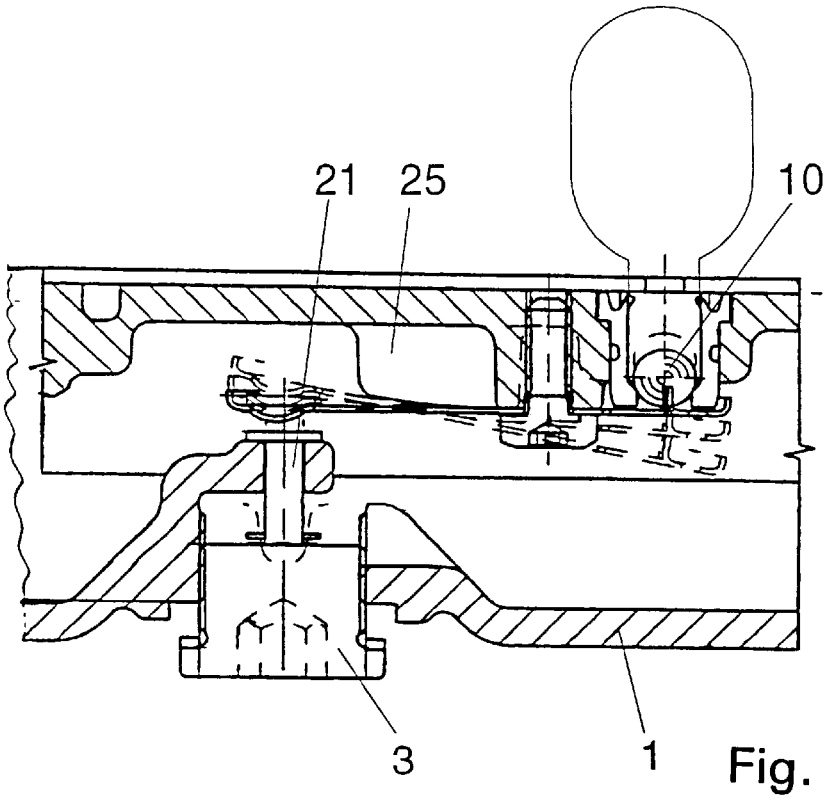
Fig. 11

DEVICE FOR DRAINING OF OIL IN A COMPONENT OF A VEHICLE

This invention relates to a device for the complete draining of oil in a component of a motor vehicle containing oil such as hydraulic steering, a transmission with a converter or an automatic transmission wherein the device has a plug located in the lowest place of the component and removable for the purpose of oil draining.

BACKGROUND OF THE INVENTION

In the oil changes performed at regular intervals in such components of a motor vehicle, a considerable residual amount of oil always remains in the component when said component has interior oil chambers which are not drained when the oil is changed. The component itself is usually provided on its lowest point with a drain opening which is closed by a plug, the plug generally having an outer thread which meshes in an inner thread of the drain opening. If the plug is now removed for the purpose of draining oil, the oil contained above the drain opening in the component freely flows out as a result of gravity and is collected while the residual oil remains in the closed oil chambers.

In order to be able to make the oil change intervals as long as possible, a complete oil in the component must be achieved in the course of an oil change.

Therefore, in an already known component of a motor vehicle, it has already been proposed not only that the component be provided with a removable plug at its lowest point, i.e the oil pan, but also that an oil chamber, such as in a hydraulic steering existing above the plug likewise be provided with a plug in its lowest place. After removal of the plug of the component and outflow of part of the amount of oil from the component, the plug of the oil chamber, which is of smaller diameter, is manually removed through the drain opening in the component so that the oil contained therein flows out through the two drain openings.

However, this known device also has the disadvantage that the smaller plug, i.e. the oil drain plug of the hydraulic steering in the component, can be removed only a certain time after removal of the plug of the component. This involves the possible error that the removal of the smaller plug be forgotten or that the closing of the smaller drain opening of the oil chamber be forgotten after removal of both oil amounts and before the renewed filling of the component. If the oil chamber within the component is a hydraulic steering, then no system pressure generates during the whole operation. Another possible error is to be seen in that the smaller plug in the oil chamber is not tightened with enough force so that during the running of the vehicle the plug of the smaller diameter is removed from its opening whereby the system pressure likewise drops.

The problem to be solved by this invention is to provide a device for complete draining of the oil contained in a component of a motor vehicle, such as hydraulic steering, transmission with converter or automatic transmission with which device, during oil change, reliably and simultaneously with the removal of the plug of the component, oil chambers otherwise closed, is opened and is again closed when inserting the plug in its drain opening in the component.

SUMMARY OF THE INVENTION

The advantage attained with the device, according to the invention, is that consumed oil, otherwise contained in the closed oil chambers, is additionally drained during the oil change, that the draining also includes the otherwise inaccessible oil chambers simultaneously with the draining of the oil above the drain opening in the component, and that the oil chambers through the device be reliably sealed when inserting the plug in the drain opening of the component prior to refilling the component.

BRIEF DESCRIPTION OF THE DRAWINGS

The invention is explained in detail herebelow with reference to the drawings where advantageous embodiments are shown. The drawings show:

FIGS. 8 to 11 are sections and a topview of a third embodiment.

DESCRIPTION OF THE PREFERRED EMBODIMENT

The point of departure of the invention is that within the component, such as an automatic transmission for a motor vehicle, at least one oil drain valve is provided on the lowermost place of an oil chamber otherwise inaccessible in the component, said oil drain valve being automatically opened when the plug of the component is removed for oil change purposes without the oil drain valve necessarily having to be provided directly above the drain opening in the component, since after removal of the plug it is not manually actuated from the outside.

Figure 1:
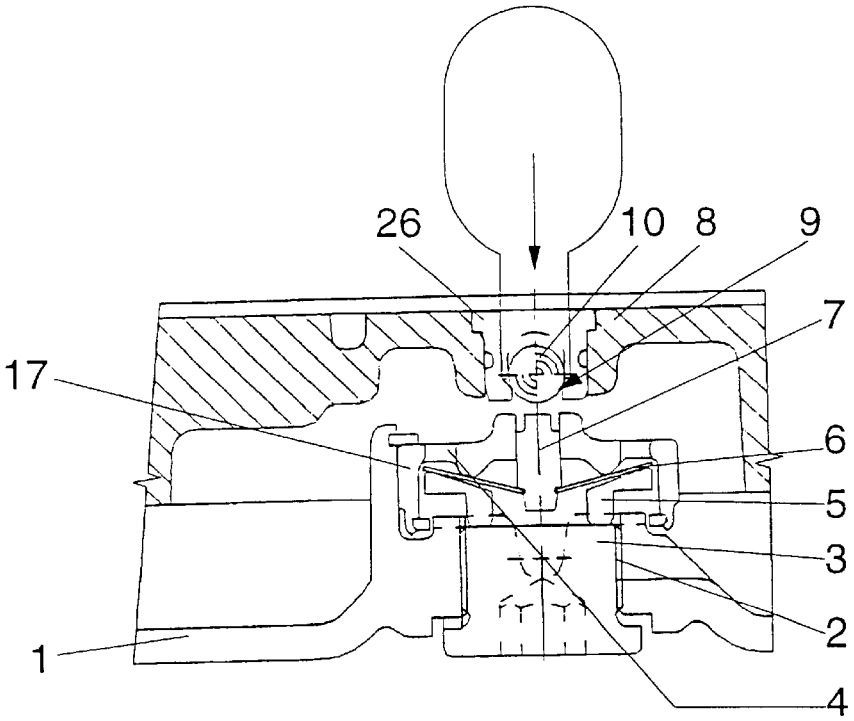
FIGS. 1 to 3 are sectional representations of a first embodiment according to the invention.
Figure 2:
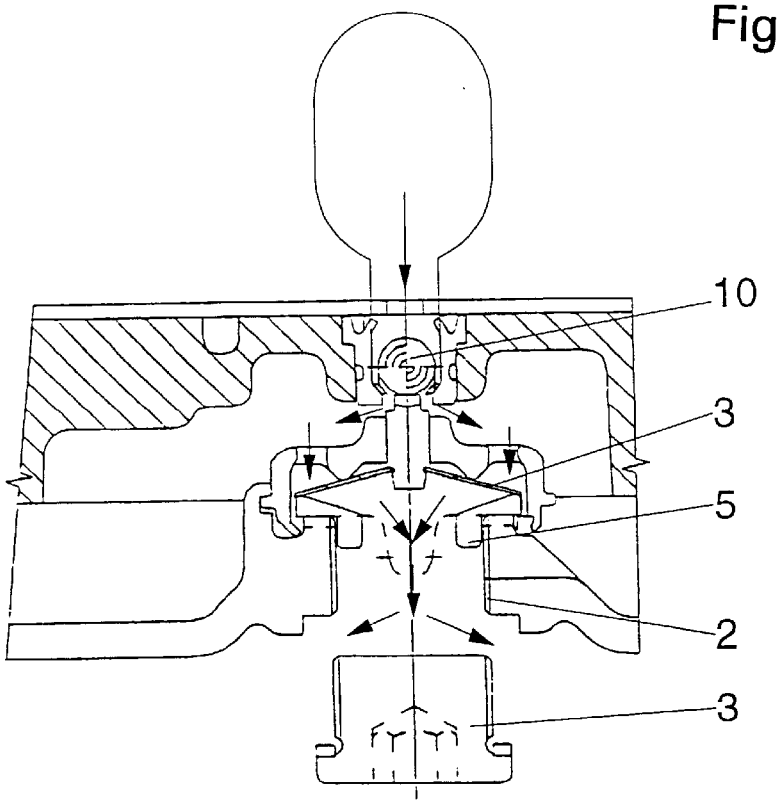
Figure 3:
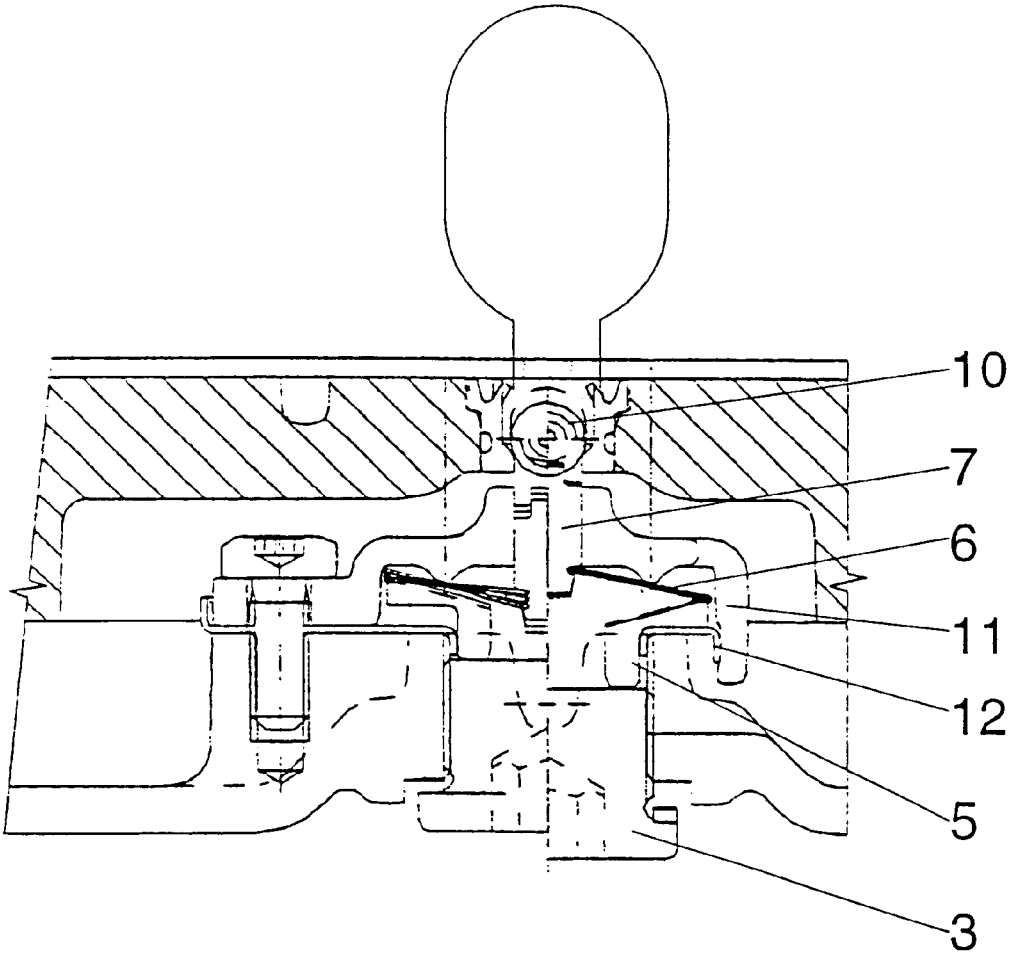

In the embodiment, shown in FIGS. 1 to 3, is diagrammatically designated with 1 the oil pan of a component of a motor vehicle, such as of an automatic transmission, which is conventionally provided with a drain opening 2 in which a removable plug meshes. Above the plug 3 and on the lowermost place of an oil chamber in the component, which in the embodiment shown, is delimited by a duct plate 8, is now provided an oil drain valve comprised of a valve seat 9 built in a connecting piece 26 and, inserted in the valve seat, a ball 10 having a diameter larger than the passage diameter of the valve seat 9.

Between the oil drain valve and the top side of the plug 3 is provided a bracket 17 with an inner opening 4 which makes possible the oil flow, a plate spring 6 and a tappet 7 located in the center of the plate spring 6 in prolongation of the axis of the connecting piece 26 and thus below the ball 10. With 5 is designated a sliding driver.

FIG. 1 now shows the position in which the drain opening 2 through the plug 3 is closed. The plate spring 6 is prestressed in this position, corresponding to the working position, whereby the upper end of the tappet 7 is at a certain distance from the ball 10. By the driver 5 the outer diameter of the plate spring 6 is upwardly pressed whereby the tappet 7 is simultaneously drawn downwardly. Due to the oil pressure prevailing within the duct plate 8 and/or the gravity, the ball 10 is pressed downwardly and thus against the valve seat 9 in the duct plate 8. The oil volume above the valve seat 9 is thereby shut off, it being possible further to assist the operation of the ball 10 by a spring (not shown).

FIG. 2 shows the position in which the plug 3 has been removed from the drain opening 2 and thereby the oil drain valve in the duct plate 8 has been opened automatically. The driver 5 is downwardly pressed by the prestressed plate spring 6 whereby the tappet 7 is simultaneously pressed upwardly and the ball 10 removed from the valve seat so that the oil contained within the duct plate 8, as indicated by the arrow, can freely flow out and leave the component through the drain opening 2.

According to FIG. 3, it is advantageous for centering the components to situate an intermediate plate 12 in the thread of the drain opening 2 after which the driver 5 is centered in the intermediate plate 12. Together with the snap fixing on the tappet, shown in FIGS. 4 and 5, a front-mounted unit is obtained which is easy to mount and available as complete assembly. In addition, the intermediate plate 12 has the function of completing the components tappet 7, plate spring 6 and driver 5 with the oil outlet to a front-mounted assembly.

Figure 4:
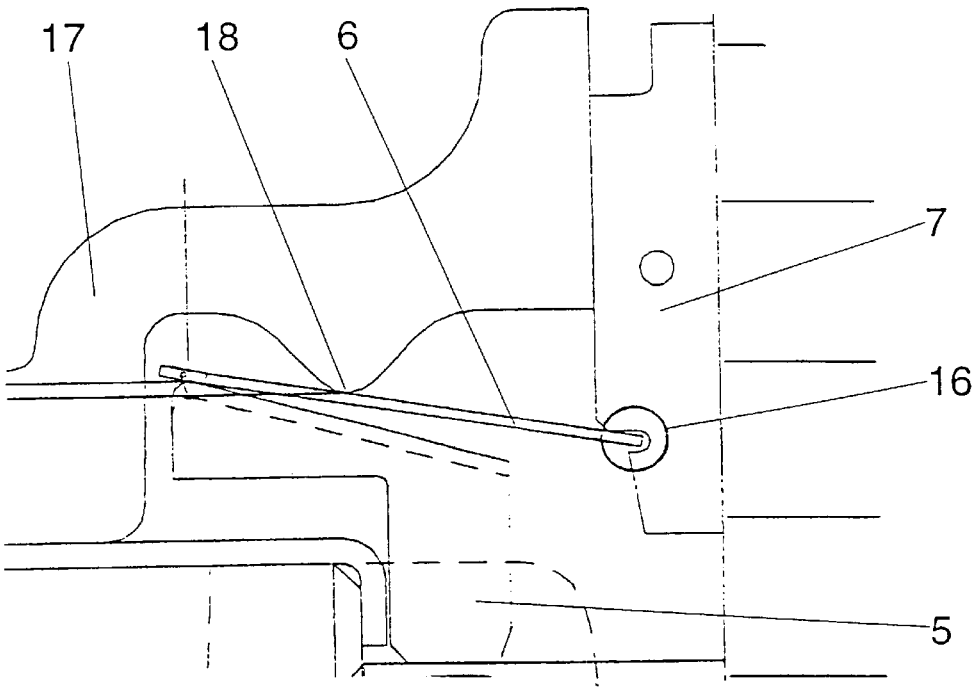
FIGS. 4 and 5 are enlarged representations of details of said embodiment.
Figure 5:
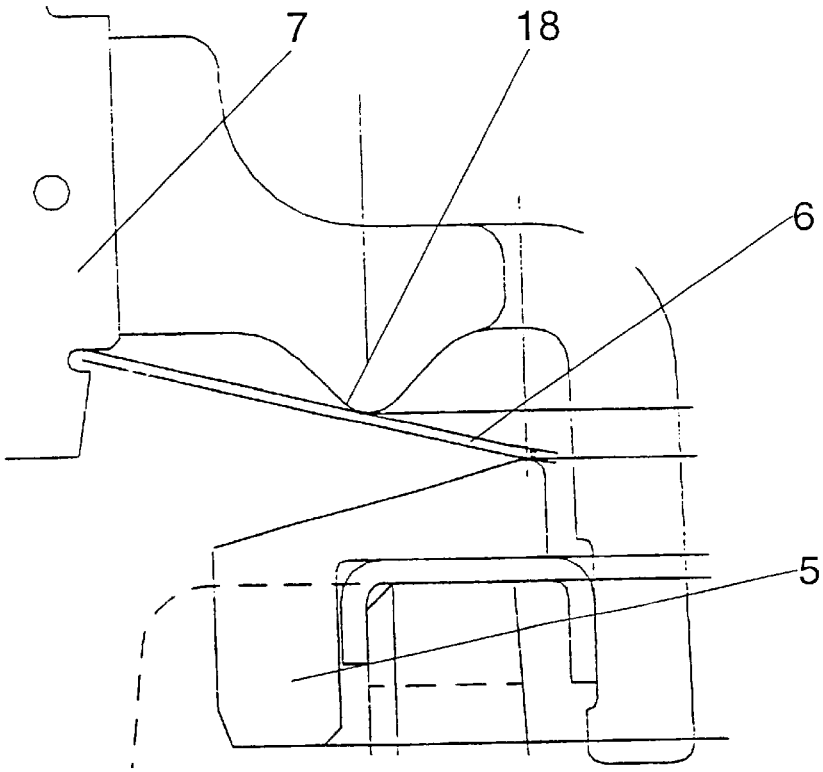

The snap fixing 16 for the plate spring 6, shown in FIGS. 4 and 5, is especially advantageous. For this purpose, the inner side of the bracket 17, facing the plate spring 6, has a projection 18 and a recess in the tappet 7 in which meshes the inner end of the plate spring 6. Thereby forces can be transmitted in both directions of movement, i.e. upwardly and downwardly. The direction of movement of the plug is at the same time, opposite to the direction of movement of the tappet 7. The plate spring 6 produces not only forces, but is also simultaneously used as shift lever for reversing the direction of movement.

Figure 6:
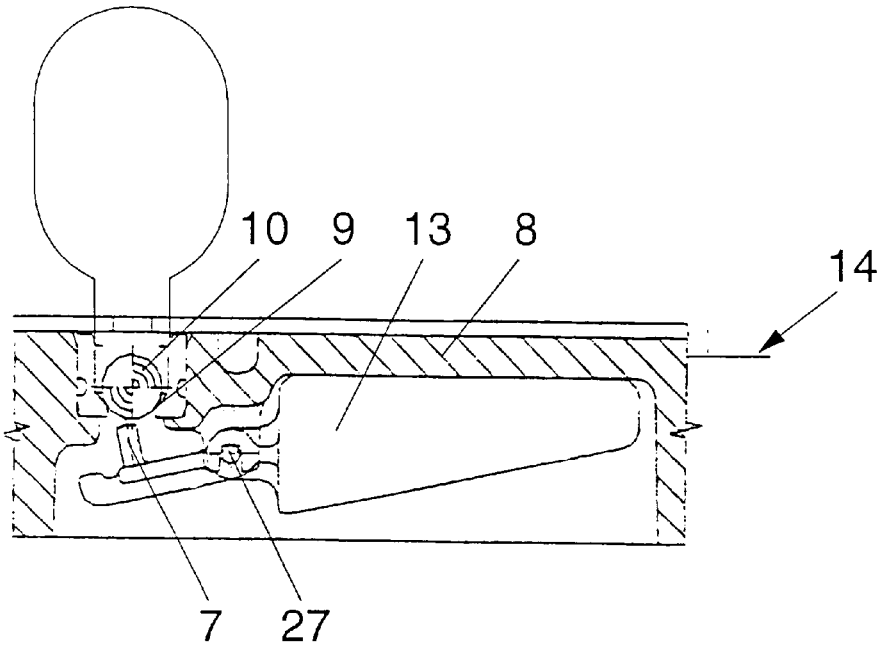
FIGS. 6 and 7 are sections through a second embodiment.
Figure 7:
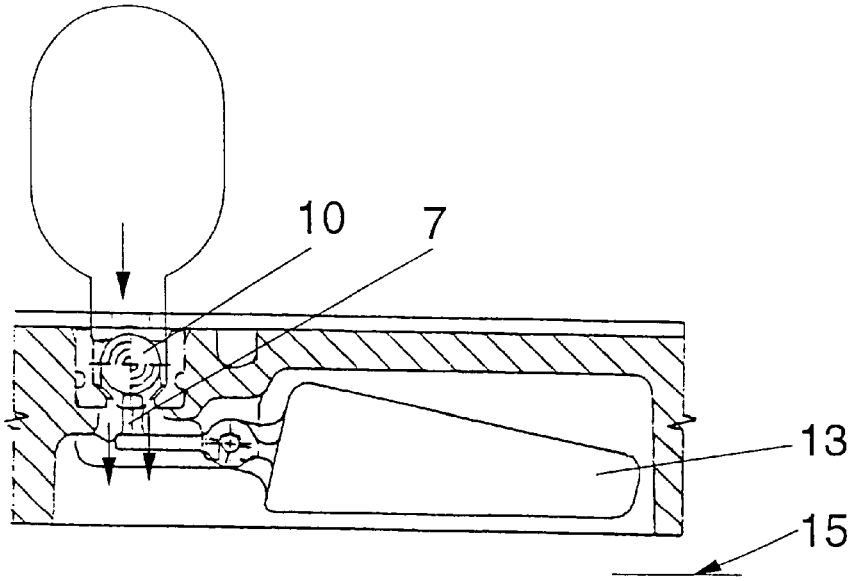

FIGS. 6 and 7 show a second embodiment of a device, according to the invention, wherein with 9 and 10 are designated again the valve seat and the ball of the oil drain valve in a duct plate whereby an oil amount is shut off within the oil chamber formed thereby. The device now has a float 13 disposed beneath the duct plate 8 and flexibly mounted on an axle 27. With the float is connected, via an arm a tappet 7, which is situated beneath the ball 10 and spaced therefrom as long as the space within the component, i.e. beneath the duct plate 8, is filled with oil. This upper oil level is designated with 14 in FIG. 6.

If the plug (not shown in this embodiment) for the component is now opened so that the oil contained therein flows out, the oil level sinks and thus also the float 13 whereby the tappet 7 lifts the ball 10 from its valve seat 9. Additionally, the oil, contained in the oil chamber of the duct plate 8, thereby can additionally flow out to the oil contained in the component, as indicated by the two arrows in FIG. 7. The lower oil level is here symbolically designated with 15.

It is to be observed in this embodiment that the thickness of the float 13 is less than the thickness of the oil contained in the component in order that the float 13 has enough lift and during the working use, i.e. when the drain opening is closed, the ball 10 abuts more consistently on the valve seat 9. It is further to be noted that the opening force of the sinking float is stronger when the plug is removed than the closing force of an optionally spring loaded ball 10.

Figure 8:
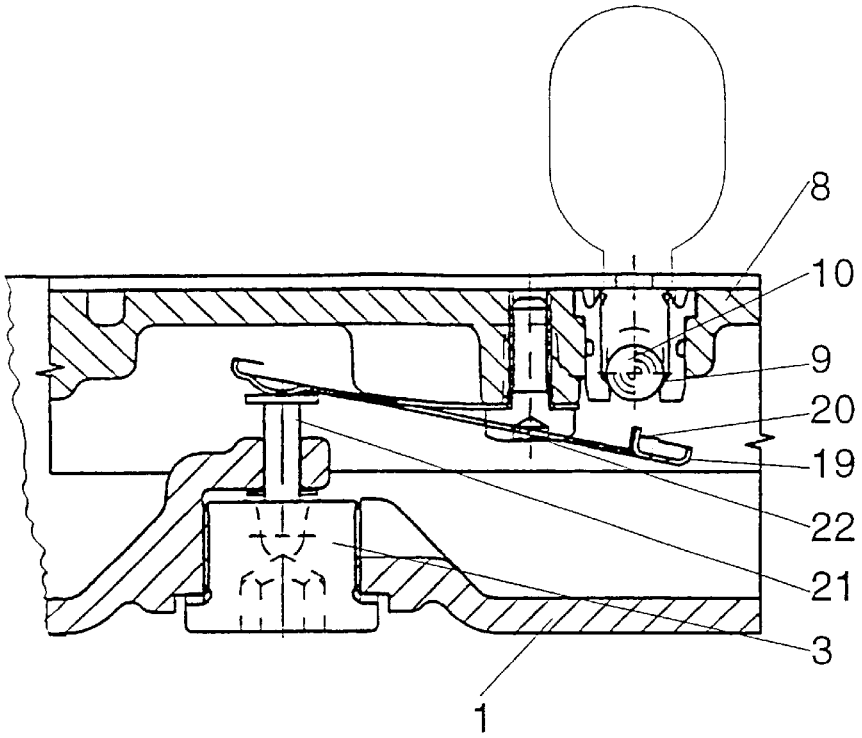

In the embodiment, shown in FIGS. 8 to 11, the duct plate 8 with the oil chamber that delimits it is, in turn, shut off by a ball 10 which abuts on a valve seat 9. The device for automatically opening the oil drain valve here has a spring plate 19 fixed at 22 which, at one end, is provided with a tab 20 which is situated beneath the ball 10 and supports itself by its other end on a bolt 21 upon the plug 3. The bolt 21 preferably penetrates an opening provided in the oil pan of the component 1 so that, as FIG. 8 shows, in inserted state of the plug 3 the spring plate 19 is moved by the bolt 21 in a manner such that the tab 20 is at a certain distance from the ball 10. In this position the spring plate 19 can be deformed. The ball 10, in turn, is pressed by the oil pressure within the duct plate or the gravity in the valve seat 9 into the duct plate.

Figure 9:
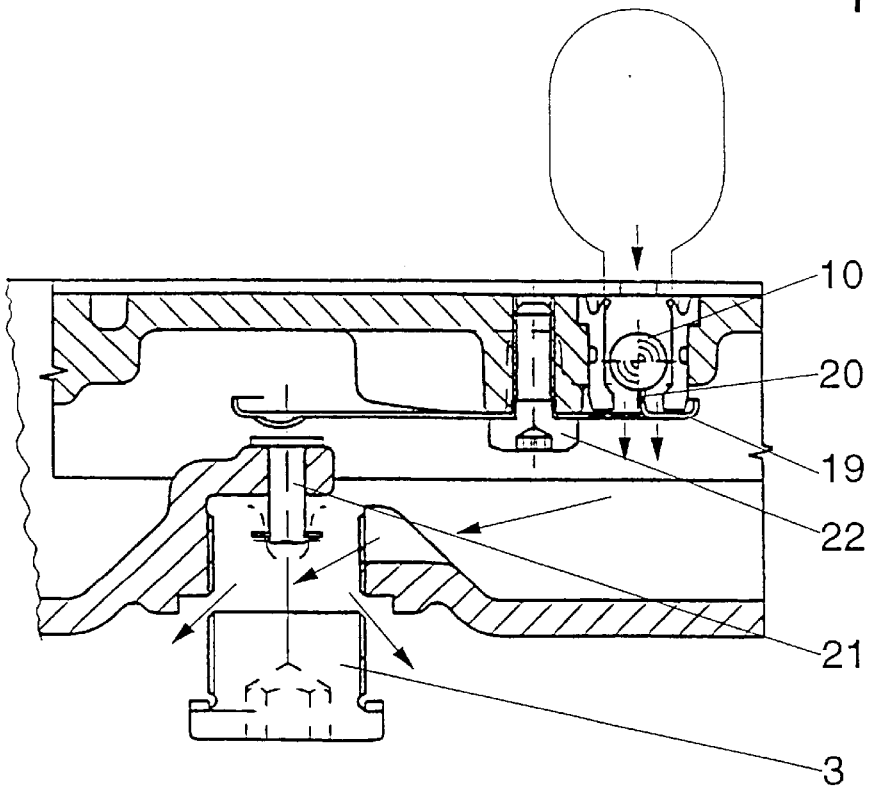

If the plug 3 is removed, the projection slides downwardly due to unloading of the spring plate 19 and the ball 10 is lifted from its valve seat 9 by the tab 20 on the spring plate 9 so that the oil contained in the oil chamber 9 of the duct plate 8 can flow out, as indicated by the arrows in FIG. 9.

FIG. 10A shows a topview on an adequate spring plate 19 and FIG. 10B an axial section along the line marked by the two arrows in FIG. 10A. With 23 is at the same time designated the spring range of the spring plate designed as plate spring and with 24 the lever range. In the lever range is situated the tab 20 which is needed for lifting the ball 10. The end of the spring plate 19 facing the tab preferably has a bead 28; the stability of the lever range 24 of the spring plate 19 is increased by the rotary bead.

With 25 is further designated a cap strip which, as can be understood from FIG. 11, takes care of a targeted deformation of the spring plate. With the cap strip 25, an even deformation of the spring range is obtained and therewith an even distribution of stress within the spring plate. There is further ensured a targeted lifting of the lever range 24 and thus of the tab 20 from the ball 10 in the valve seat 9.

REFERENCE NUMERALS

1 component
2 drain opening
3 plug
4 opening
5 driver
6 plate spring
7 tappet
8 duct plate
9 valve seat
10 ball
11 housing
12 intermediate plate
13 float
14 upper oil level
15 lower oil level
16 snap fixing
17 bracket
18 projection
19 spring plate
20 tab
21 bolt
22 support
23 spring range
24 lever range
25 cap strip
26 connecting chamber
7 axis
28 bead

What is claimed is:

1. A device for facilitating substantially complete draining of oil from an oil chamber of a motor vehicle component, the oil chamber of the component having an opening located in a vertically lowermost portion thereof to facilitate removing oil from the oil chamber via the opening, and a removable plug engaging the opening of the component to seal the opening and retain the oil within the oil chamber;

wherein the oil chamber of the component (1) is separated into at least two internal oil chambers by at least one oil drain valve (9, 10), and the oil drain valve (9, 10) is automatically opened, to facilitate oil flow between the two internal oil chambers, when the plug (3) is removed from the opening.

2. The device according to claim 1, wherein a connecting chamber (26) is provided in a housing (8) separating the two internal oil chambers from one another, the connecting chamber defines a valve seat (9) with a ball (10) normally closing the valve seat (9) to prevent oil flow therethrough, and a structure, connected with the plug (3), is provided for disengaging the ball from the valve seat to facilitate flow through the valve seat.

3. The device according to claim 2, wherein the structure comprises a plate spring (6) disposed concentrically with respect to the connecting chamber (26) and the plate spring (6) supports a tappet (7), and, when the plug is engaged with the opening, the plate spring (6) is prestressed by the plug (3) into a position where the tappet (7) is spaced from the ball (10), and, when the plug is disengaged from the opening, the plate spring (6) biases the tappet to disengage the ball (10) from the valve seat and allow oil flow through the valve seat.

4. The device according to claim 1, wherein a connecting chamber (26) is provided in a housing (8) separating the two internal oil chambers from one another, the connecting chamber defines a valve seat (9) with a ball (10) normally closing the valve seat (9) to prevent oil flow therethrough, a structure is provided for disengaging the ball from the valve seat to facilitate flow through the valve seat, the structure comprises a float (13) located within a vertically lowermost one of the two internal oil chambers, and one end of the structure is provided with a tappet (7) which is disposed vertically beneath the ball (10) to lift the ball from the valve seat when the float (13) vertically drops within the oil chamber as a result of oil draining from the lowermost one of the two internal oil chambers.

5. The device according to claim 2, wherein the structure comprises a spring plate (19) located in a lowermost one of the two internal oil chambers, the spring plate (19) has a first end provided with a tab (20) which is located beneath the ball (10) to facilitate disengagement of the ball from the valve seat, and a second opposed end of the spring plate (19) contacts the plug (3).

6. A device for facilitating substantially complete draining of oil from an oil chamber of a motor vehicle component, the oil chamber of the component having an opening located in a vertically lowermost portion thereof to facilitate removing oil from the oil chamber via the opening, and a removable plug engaging with the opening of the component to seal the opening and retain the oil within the oil chamber;

wherein the oil chamber of the component (1) is separated into at least two internal oil chambers by at least one oil drain valve (9, 10), and the oil drain valve (9, 10) is mechanically coupled to the plug (3) so as to be automatically opened, to facilitate oil flow between the two internal oil chambers, when the plug (3) is removed from the opening and to be automatically closed, when the plug (3) is engaged with the opening, to prevent oil flow between the two internal oil chambers.

7. The device according to claim 6, wherein the component has a housing (8) and a connecting chamber (26) is provided in the housing (8) and separates the two internal oil chambers from one another, the connecting chamber defines a valve seat (9) with a ball (10) normally closing the valve seat (9) to prevent oil flow therethrough, and a structure mechanically couples the plug (3) to the ball for disengaging the ball from the valve seat to facilitate flow through the valve seat.

8. The device according to claim 7, wherein the structure comprises a plate spring (6) disposed concentrically with respect to the connecting chamber (26) and the plate spring (6) supports a tappet (7), and, when the plug is engaged with the opening, the plate spring (6) is biased by the plug (3) into a position where the tappet (7) is spaced from the ball (10), and, when the plug is disengaged from the opening, the plate spring (6) biases the tappet to disengage the ball (10) from the valve seat and allow oil flow through the valve seat.

9. The device according to claim 7, wherein the structure comprises a spring plate (19) located in a lowermost one of the two internal oil chambers, the spring plate (19) has a first end provided with a tab (20) which is located beneath the ball (10) to facilitate disengagement of the ball from the valve seat, and a second opposed end of the spring plate (19) is mechanically coupled with the plug (3).

10. A device for facilitating complete draining of oil from an oil chamber of a motor vehicle component, the oil chamber of the component having an opening located in a vertically lowermost portion thereof to facilitate removing oil from the oil chamber via the opening, and a removable plug engaging the opening of the component to seal the opening and retain the oil within the oil chamber;

wherein the oil chamber of the component (1) is separated into at least two internal oil chambers by at least one oil drain valve (9, 10), and the at least one oil drain valve (9, 10) is automatically opened, to facilitate oil flow between the at least two internal oil chambers, when the plug (3) is removed from the opening, and the at least one oil drain valve (9, 10) is closed, whereby when the plug (3) is reinstalled within the opening oil flow is discontinued between the at least two internal oil chambers;

the component has a housing (8) and a connecting chamber is provided in the housing (8) and separates the at least two internal oil chambers from one another, the connecting chamber defines a valve seat (9) with a ball (10) normally closing the valve seat (9) to prevent oil flow therethrough, and a structure is provided for disengaging the ball from the valve seat and facilitate flow through the valve seat, and the structure comprises a float (13) located within a vertically lowermost one of the at least two internal oil chambers, and one end of the structure is provided with a tappet (7) which is disposed vertically beneath the ball (10) to lift the ball from the valve seat when the float (13) vertically drops within the oil chamber due to the removal plug being removed, and when the removal plug is reinstalled in the opening, the oil continues to flow into the vertically lowermost one of the at least two internal oil chambers causes the float to rise and disengage the tappet from the ball thereby allowing the ball to seat against the ball seat and discontinue oil flow into the vertically lowermost one of the at least two internal oil chambers.

* * * * *